United States Patent [19]

Lehtinen

[11] 4,112,586

[45] Sep. 12, 1978

[54] METHOD OF DRYING A CARDBOARD OR A PAPER WEB AND DRYING DEVICE FOR APPLYING THIS METHOD

[75] Inventor: Jukka A. Lehtinen, Tampere, Finland

[73] Assignee: Oy. Tampella AB, Tampere, Finland

[21] Appl. No.: 748,736

[22] Filed: Dec. 9, 1976

[30] Foreign Application Priority Data

Dec. 30, 1975 [FI] Finland ..... 753689
May 28, 1976 [FI] Finland ..... 761516

[51] Int. Cl.[2] ..... F26B 3/00; F26B 13/26

[52] U.S. Cl. ..... 34/9; 34/71; 34/95

[58] Field of Search ..... 34/17, 18, 19, 9, 95, 34/69, 71

[56] References Cited

U.S. PATENT DOCUMENTS

| | | | |
|---|---|---|---|
| 2,207,278 | 7/1940 | Albrecht | 34/95 |
| 3,096,161 | 7/1963 | Morrison et al. | 34/18 X |
| 3,214,327 | 10/1965 | Wicker et al. | 34/95 |
| 3,214,330 | 10/1965 | Wicker et al. | 34/95 |
| 3,525,160 | 8/1970 | Dokoupil et al. | 34/95 |
| 3,973,329 | 8/1976 | Feess | 34/9 |

*Primary Examiner*—John J. Camby

[57] ABSTRACT

A method of drying a cardboard or a paper web by passing the wet web supported by a drying band between two moving, nonpermeable surface elements having good heat conducting properties. The surface element contacting the web is subjected to heating and the surface element contacting the drying band is subjected to cooling. Due to the heating of the web the water contained therein is caused to evaporate and the evaporated water is caused to condense into the drying band due to the cooling of the drying band. The water is removed from the drying band after the web and the drying band have left the surface elements and have been separated from each other.

15 Claims, 6 Drawing Figures

Figure 1:
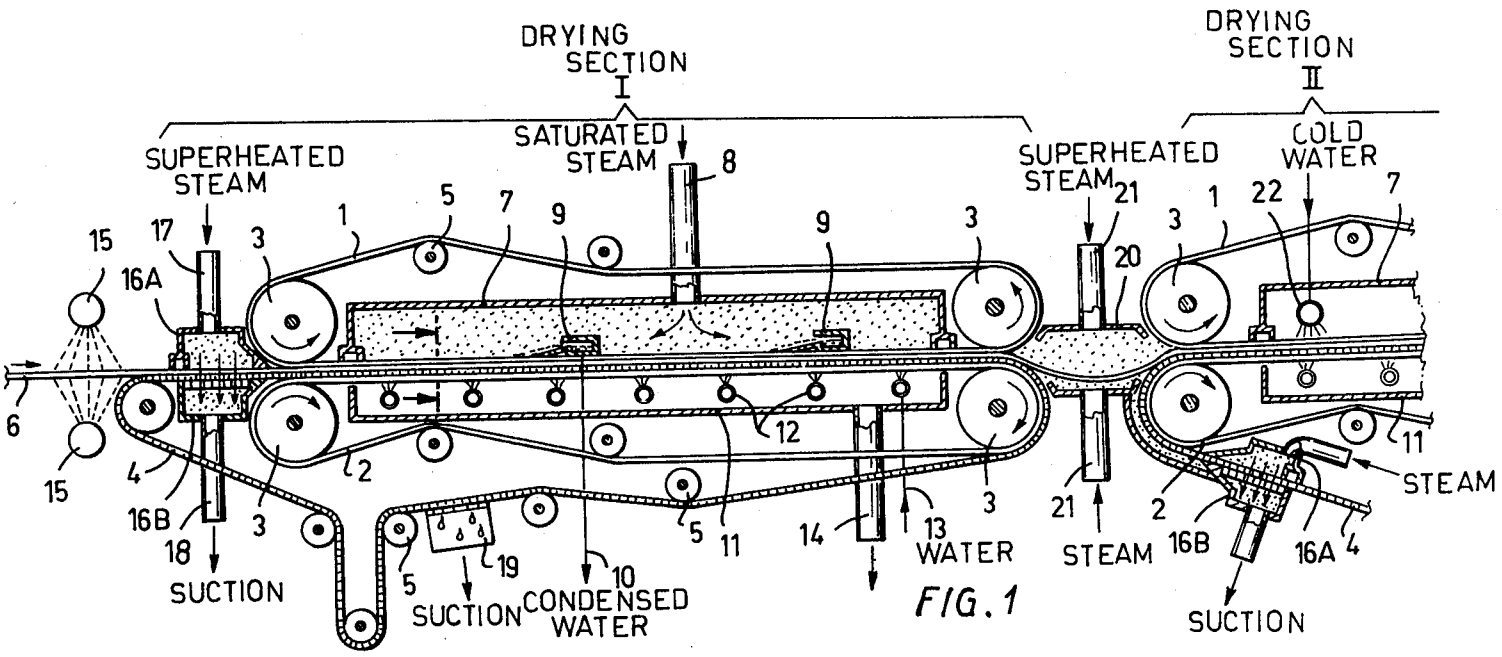

METHOD OF DRYING A CARDBOARD OR A PAPER WEB AND DRYING DEVICE FOR APPLYING THIS METHOD

This invention relates to a method of drying a cardboard or a paper web by passing the web supported by a drying band into contact with a heated drying surface in order to evaporate water from the web.

Cardboard and paper drying is carried out today mainly by means of cylinder dryers comprising several rotating cylinders which are internally heated with steam, and against the surfaces of which the web is pressed by means of a felt or a drying wire. There are, however, disadvantages in this drying method: the big size of the drying device, the high purchase price, the high operating costs, the operating stoppages caused by frequent web breaks, as well as the dangerous situations arising from the breaks.

To some extent air-float dryers are also used in which the web is supported horizontally by a zone of hot air jets. The process results in a web with a less smooth surface than that produced with cylinder dryers, and the drying costs are higher than when using cylinder dryers.

Infrared-dryers are also used in which heat radiation is generated either by means of electric resistance wires or by burning gas. Devices of this type are mostly used only as auxiliary dryers.

The object of this invention is to provide a drying method which in many respects is more advantageous than the presently used drying methods. This object is reached by a method in accordance with the invention, the characteristics of which are that the wet web and the drying band are passed between two moving, non-permeable surface elements having good heat conducting properties, and which enclose the web along its whole width, that the surface element contacting the web is subjected to heating, and the surface element contacting the drying band is subjected to cooling in order to condense water evaporating from the web into the drying band, and that the drying band is separated from the dry web after they left the surface elements, and the condensed water is then removed from the drying band.

The method in accordance with the invention facilitates the drying of a cardboard or a paper web by using the so-called suction drying principle, the general basis of which is that the liquid or material to be dried is in contact only with evaporating steam. When the pressure of the eavaporating steam is kept low by condensing the steam upon some cold surface, the evaporation takes place at a low temperature and at a low pressure. In spite of the low evaporation temperature the speed of evaporation is very high, because the evaporating liquid boils and the heated surface can be several degrees warmer than the liquid itself. The temperature of the liquid thus reaches a value between the temperatures of the evaporating surface and the condensing surface. By passing the web to be dried and the drying band between two surface elements, one of which is heated and the other is cooled, the web undergoes such a suction drying in a continuous process by causing the surface elements to run at the same speed as the web and the drying band.

Considerable advantages in suction drying according to the invention are the high drying speed at a low temperature, the simplicity of the process and the uniformity of the process conditions.

The drying speed decreases sharply if air remains between the surface elements and in the web and/or in the drying band. In such a case the steam evaporating from the web has to diffuse through a layer of air in order to be able to condense near the cooled surface element. Thus, air increases the total drying resistance. For this reason, subjecting the web and the drying band to an air eliminating process before passing them between the surface elements is an essential part of the method.

The invention relates also to a drying device for applying the method in accordance with the invention. The characteristics of such a device appear from claim 11.

Advantages of the drying device according to the invention are a very low purchase price and a low cost of energy consumption as well as a moderate cost of maintenance. Furthermore, the drying device is small, noiseless and safe. The drying method in accordance with the invention does not place any restrictions on the basis weight, the speed or the quality of the web, and passing the web through the dryer as well as quality changes are easy to carry out. The drying of the web takes place at a low temperature so that the quality is good, and web breaks occur rarely.

As a drying band can be used a drying felt having numerous parallel flow canals passing through the felt perpendicularly to the surfaces thereof. In order to improve dewatering of the web to be dried it is advantageous to use a drying band in which the part facing the web is more hydrophobic than the part facing the cooled surface element.

When the web is supported by such a drying band it is easier than when using a drying felt to make sure that the surfaces of the drying band and the cooled surface element, when needed, are such that the steam condensed thereon can be removed as easily as possible, whereby at the same time the risk decreases that the water which has evaporated from the web into the drying band would return into the web at some stage of the process. By making the surface of the drying band facing the web more hydrophobic than the surface facing the cooled surface element the water, which has evaporated from the web, is prevented to pass by means of capillarity back into the web even if the drying band would run above the web.

In addition to the advantages explained above the use of a drying wire instead of a drying felt saves both in the purchase price and in the maintenance costs due to longer wire change intervals.

The water resistance of the wire is accomplished by treating it with some suitable substance or by coating it suitably. It is also advantageous that the surface or the wire of the drying band which faces the cooled surface element is more water resistant than said cooled surface element. In this manner it is possible to obtain that either the drying band or the cooled surface element retains more water when the cooled surface element and the drying band are separated.

Figures 4, 5, 6:
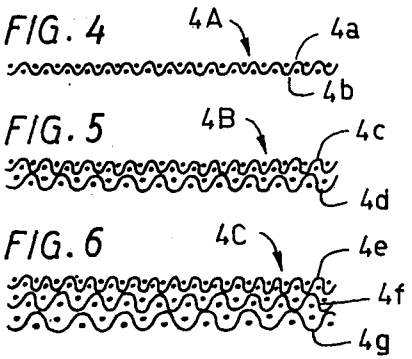
Figure 3:
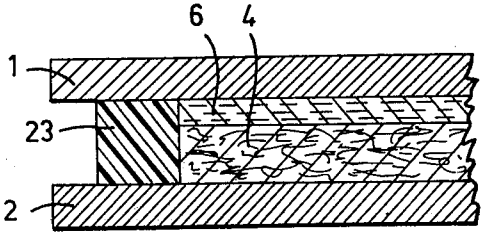
Figure 2:
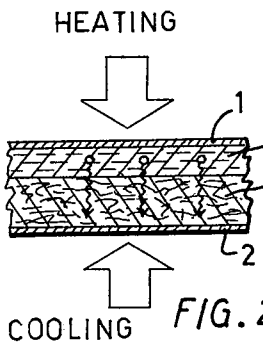

In the following the invention will be described more closely with reference to the accompanying drawing in which FIG. 1 is a schematic side view of one embodiment of a drying device for carrying out the drying method provided by the invention, FIG. 2 is an enlarged section along line II—II in FIG. 1, FIG. 3 is an enlarged section of the edge part of the bands, and FIGS. 4–6 are enlarged cross sections of embodiments of a drying band having surface portions with different hydrophobic properties.

The dryer illustrated in the drawing comprises mainly two surface elements 1 an 2 formed by two endless bands, which are of nonpermeable stainless steel or other metal, rubber or plastic. The surface elements run over horizontal turning rolls 3, so that between those parts of the surface elements which are positioned close to each other remains essentially a space with corresponds to the thickness of the web and the drying band. An endless drying band 4, in this case a drying felt, runs between the surface elements, passes over the other turning roll 3, and returns by a route below the lower surface element, passing over ordinary guide rolls 5. The surface elements are wider than the web. The cardboard or paper web to be dried is indicated with the reference numeral 6.

The dryer further comprises a steam chest 7, which is placed above the lower run of the upper surface band 1 and into which saturated steam (100° C., 1 bar) is supplied from a tube 8. The chest is further provided with condensate collectors 9 and outlet tubes 10 for condensed water (100° C.). A shower chest 11 is positioned underneath the upper run of the lower surface element 2, in which shower chest there is a group of tubes 12 for spraying cooling water having a temperature of 0–20° C. upon the lower surface of the surface element. The inlet tube for water is indicated with 13, and the outlet tube for used cooling water is indicated with 14.

On opposite sides of the web before it passes between the surface elements are located radiant heaters 15, and after the heaters a steam chest 16A into which superheated steam (about 120° C.) is supplied from a tube 17, and a suction box 16B which is subjected to suction by means of a suction tube 18. For drying the drying band there are suction boxes 19.

In the described construction the dryer comprises two drying sections I and II in succession, between which drying sections there is a steam space 20, the top and bottom of which are covered, but the sides open. Super-heated steam (about 120° C.) is supplied into the steam space from tubes 21.

The corresponding parts of the drying section II are provided with the same reference numerals as in the drying section I. The drying section II is further provided with an apparatus 22 for regulating the humidity profile of the web by means of cold water, and the construction of the suction-steam box 16 differs from that of section 1.

The drying of the web is accomplished as follows:

The web is passed through the radiant heaters 15, which burn gas or use electrical resistances, whereby the temperature of at least the surfaces of the web rises up to 100° C. The generated steam pushes air out of the web. Thereafter the web and the drying band are passed together over the suction box 16B, and at the same time superheated steam from the air tight steam box 16A is blown through the web and the drying band. The superheated steam pushes the remaining air out of the web and the drying band. After this the web and the drying band are not allowed to contact air before they enter between the surface elements 1, 2.

The leaking of air into the drying band or the web from the sides of the machine is prevented, for instance by suitable seals 23 at the edges of the drying band (FIG. 3).

The surface elements 1, 2 move at the same speed as the drying band and the web. While passing under the steam box 7 the upper surface element 1 is heated by the action of the saturated steam which flows into the chest. The steam condenses on the surface of the upper surface element and the condensate is removed, or it drops off. The latent heat of condensation passes through the upper surface element into the wet web. The moisture of the web evaporates at a temperature of 60°–90° C., whereby the pressure (abs) of the evaporating steam is 0.20–0.69 bar. This steam passes through the drying band into the vicinity of the lower surface element 2. By means of cold water spraying the temperature of this surface element is kept at about 10°–40° C. while passing over the shower chest 11. Thus the steam evaporated from the web condenses correspondingly at a pressure (abs) of 0.01–0.12 bar. The drying flux becomes extremely high, and it is possible to reach drying values which greatly exceed the highest values presently achieved.

Because the dryer consists of several drying sections I, II, the web separates between the sections from the drying band, and is thus able to free itself of its residual stresses. Between the drying sections the web is prevented from contact with air by means of the steam space 20. Alternatively, the sheet can be passed from one drying section to the following completely uncovered, and the air can be removed from the web and the drying band simultaneously as they enter the second drying section.

The drying band is dried by one or more of the presently used methods, e.g. by passing it over suction boxes 19, and by blowing simultaneously superheated steam through the band. The drying band must be of a type that has numerous parallel flow canals passing through the drying band perpendicularly to the surfaces thereof, but hardly allows any gas flow in the machine direction or the cross machine direction.

With this dryer it is a very easy and safe procedure to pass the front end of the web through the dryer. A support rope can also be used between the drying sections.

The air eliminating process and the drying of the drying bands causes an air-steam mixture, the temperature of which is about 100° C. The enthalpy of this can be utilized in the same way as the enthalpy of the humid air resulting from the hood of a normal dryer is being used at present.

FIGS. 4–6 illustrate alternative embodiments of a drying band having surface portions with different hydrophobic properties The drying band 4A, FIG. 4, can consist of one paper machine wire, in which the surface **4*a* facing the web 6** is more hydrophobic than the surface facing the cooled surface element. The wire has to be of a texture fine enough not to leave harmful marks in the web, and thick enough to hold easily all the water leaving the web. The wire can be either of metal or plastics.

It is also possible that the drying band 4B, FIG. 5, consists of two wires placed one on top of the other, whereby the wire **4*c* facing the web 6 is of fine texture and hydrophobic, and the wire 4*d* facing the cooled surface element 2 is coarse and less hydrophobic than the wire facing the web. The wire 4*c*** facing the web has to be of a texture fine enough to avoid marks in the web, and the other wire *4d*, which collects the condensate, has to be spacious enough to receive all the water coming from the web. The wires can be either of metal or plastics.

Alternatively, the drying band 4C, FIG. 6, can consist of three wires laid one on top of the other, whereby the wire *4e* facing the web 6 is of fine texture, the wire *4f* in the middle is hydrophobic, and the wire *4a* facing the cooled surface element 2 is less hydrophobic than the wire in the middle. The wire *4e* facing the web has again to be of a texture fine enough in order not to cause markings in the web. The wire *4f* in the middle has to be intensively hydrophobic, and the wire *4g* which is located most distant from the web and collects the condensate has to be less hydrophobic and spacious enough to receive easily all the water coming from the web. The wire in the middle is advantageously of plastics only. The two other wires can be either of metal or plastics.

The drawing and the associated description are aimed only at illustrating the basic idea involved with the invention. The details of the embodiments for carrying out the method according to the invention may vary considerably within the scope of the claims.

What we claim is:

1. A method of drying a moving wet web of cardboard of paper comprising aupporting said web on a moving, drying band, contacting said web with a moving, heated drying surface in order to evaporate water from said web and into said drying band, and simultaneously contacting said drying band with a moving, cooling surface to condensed water received and contained by said drying band, removing the condensed water from said drying band and separating a dried web of cardboard or paper from the drying band.

2. A method according to claim 1, wherein the drying surface is heated with steam at a temperature of 100° C. under the pressure of one bar.

3. A method according to claim 1, wherein the cooling surface is cooled with cold water.

4. A method according to claim 1, wherein air is removed from said web and drying band before contact with said heated drying surface.

5. A method according to claim 4, wherein air is removed from said web and drying band by heating same and blowing superheated steam through said web and drying band.

6. A method according to claim 1, wherein water is removed from said drying band by subjecting said band to suction.

7. An apparatus for drying a moving wet web of cardboard or paper comprising at least one pair of surfaces formed by first and second endless, nonpermeable, movable bands capable of conducting heat, means for passing said bands in parallel over at least part of their path of movement and in the same direction on opposite sides of said web to be dried, a drying band supporting said web, said first band contacting said wet web, said second band contacting said drying band, and means for heating said first band and means for cooling said second band during parallel movement of said web and all of said bands in a forward direction.

8. An apparatus according to claim 7, wherein suction means are provided for removing water from said drying band.

9. An apparatus according to claim 7, wherein means are provided to remove air from said web and drying band before said web and drying band contacts at first and second bands.

10. An apparatus according to claim 7, wherein said means for heating said first band comprises a steam box adjacent to said first band and an inlet connected thereto for supplying saturated steam into the steam box, the side of the steam box facing said first band being open.

11. An apparatus according to claim 7, wherein said means for cooling said second band comprises a shower box adjacent said second band and shower tube provided in the shower box for spraying cooling water towards said second band, the side of the shower box facing said second band being open.

12. An apparatus according to claim 7, wherein the face of the drying band in contact with the web is more hydrophobic than the face thereof in contact with said cooling band.

13. An apparatus according to claim 12, wherein said drying band consists of one wire.

14. An apparatus according to claim 12, wherein said drying band comprises two wires positioned one on top of the other, the wire facing the web being of fine texture and hydrophobic and the wire facing the cooling band being coarse and less hydrophobic than the wire facing the web.

15. An apparatus according to claim 12, wherein said drying band comprises three wires positioned one on top of the other, the wire facing the web being of fine texture, the wire in the middle being hydrophobic, and the wire facing the cooling band being less hydrophobic than the wire in the middle.

* * * * *

UNITED STATES PATENT OFFICE

CERTIFICATE OF CORRECTION

Patent No. 4,112,586 Dated September 12, 1978

Inventor(s) Jukka A. Lehtinen

It is certified that error appears in the above-identified patent and that said Letters Patent are hereby corrected as shown below:

Claim 1, line 2, change "of" to -- or -- and "aupporting" to -- supporting --; and line 6, change "condensed" to -- condense the --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*